US005898172A

United States Patent [19]

Masui et al.

[11] Patent Number: 5,898,172

[45] Date of Patent: Apr. 27, 1999

[54] SENSOR MOUNTING STRUCTURE

[75] Inventors: Mayumi Masui; Mitsuru Hagimoto, both of Tokyo, Japan

[73] Assignee: Oki Electric Industry Co., Ltd., Tokyo, Japan

[21] Appl. No.: 08/798,994

[22] Filed: Feb. 11, 1997

[51] Int. Cl.[6] ..... H01J 5/02

[52] U.S. Cl. ..... 250/239; 403/329

[58] Field of Search ..... 250/239, 216; 24/115 M, 265 A, 297; 403/326, 328, 329

[56] References Cited

U.S. PATENT DOCUMENTS

| | | | |
|---|---|---|---|
| 5,013,911 | 5/1991 | Koshida et al. | 250/239 |
| 5,421,556 | 6/1995 | Dodge et al. | 403/326 |
| 5,678,953 | 10/1997 | Usui et al. | 403/329 |

*Primary Examiner*—Edward P. Westin
*Assistant Examiner*—Kevin Pyo
*Attorney, Agent, or Firm*—Wenderoth, Lind & Ponack, L.L.P.

[57] ABSTRACT

A sensor mounting structure superior in durability for supporting by a frame member 17 on one side of a transport path a sensor body 22, including at least one of a light emitter 18 and a light detector 19, for detecting an object being transported along the transport path 12, the mounting structure comprising a pair of rising portions 23 spaced apart from each other and rising from the frame member 17 along both sides of the sensor body 22, each rising portion having a lock portion 24; and a pair of hook portions 25 releasably engaging the lock portions 24, wherein each hook portion 25 is capable of being deformed elastically in the direction in which both hook portions 25 come closer to each other in order to engage or disengage the corresponding lock portions 24.

12 Claims, 4 Drawing Sheets

SENSOR MOUNTING STRUCTURE

BACKGROUND OF THE INVENTION

1. Field of the invention

The present invention relates to a structure for mounting a sensor structure, and more particularly to a structure for mounting a sensor suitable for mounting in a cash handling machine, such as an automatic vending machine.

2. Prior Art

An automatic cash handling machine has a sensor for detecting cash being transported, which is installed on the cash transport path to confirm the cash which is thrown into the machine.

The sensor includes a sensor body incorporating a light emitter for emitting light to a transport path, and a light detector for detecting reflected light from a coin or a bill which passes through the transport path. The sensor body has a pair of projections rigidly structured and protruding outwardly from both sides thereof. A base frame member provided on one side of the transport path includes a pair of rising portions spaced apart from each other, each rising portion having engagement holes for accepting the above-mentioned projections.

When the projections provided on both sides of the sensor body are inserted between the rising portions by spreading out both rising portions, the pair of projections engage into the engagement holes of both rising portions. Consequently, the sensor body is supported by the base frame member in a predetermined position.

The sensor body can be removed from the base frame member by spreading out the pair of projections to disengage them from the engagement holes.

However, in the conventional sensor mounting structure mentioned above, when mounting or removing the sensor body on the frame member, the projections, formed rigidly on the sensor body, are made to engage into the engagement holes provided in the rising portions. Therefore to disengage the projections from the engagement holes, the rising portions need to be deformed to a relatively large extent in the direction in which the rising portions are moved away from each other. For this reason, the pair of rising portions are conventionally formed of members having adequate elasticity, such as a synthetic resin material, for example, but no means for preventing the rising portions from being excessively deformed is provided.

Accordingly, when mounting or removing the sensor body, there is a possibility that the pair of rising portions are excessively deformed. Hence, it has been required to improve the durability of the mounting structure, including the rising portions, by preventing excessive deformation of the rising portions.

In the conventional sensor mounting structure relying on the elasticity of the pair of rising portions, a space in which each rising portion deflects needs to be secured outside of the pair of rising portions. Therefore, the conventional structure is disadvantageous in terms of the available space when sensors are to be arranged with high density.

SUMMARY OF THE INVENTION

An object of the present invention is to provide a sensor mounting structure superior in durability.

Another object of the present invention is to provide a sensor mounting structure enabling a compact design of the structure without securing space needed for the deformation of the rising portion.

According to the present invention, there is provided a sensor mounting structure for supporting, by a frame member on one side of a transport path, a sensor body, including at least one of a light emitter and a light detector, for detecting an object being transported along the transport path. The mounting structure comprises a pair of rising portions spaced apart from each other and rising from the frame member along both sides of the sensor body, each rising portion having a lock portion.

A pair of hook portions releasably engage the lock portions, wherein each hook portion is capable of being deformed elastically in the direction in which both hook portions come closer to each other in order to engage or disengage the corresponding lock portions.

In the present invention, mounting or removal of the sensor body does not depend on the deflection of a pair of rising portions as in the prior art, but depends on the elastic displacement of the hook portions provided on both sides of the sensor body to correspond to the lock portions in the pair of rising portions.

According to the present invention, a pair of hook portions provided on both sides of the sensor body are permitted to be displaced elastically in the direction in which the hook portions come closer to each other, and the side wall portions of the sensor body regulates excessive displacement of the hook portions. That is, the present invention provides a sensor mounting structure having superior durability achieved by preventing the hook portions from being subject to excessive deformation and displacement without providing any special regulating means and therefore by preventing a decrease in durability resulting from the excessive deformation and displacement.

Moreover, the pair of rising portions having the lock portions into which the hook portions engage are designed not to be subjected to as large a deflection as they used to be in the prior art when mounting or removing the sensor body. Therefore, it is not necessary to secure a space for such deflection, and on that account a plurality of rising portions can be arranged close to one another, and the mounting density can be increased due to space savings, which is advantageous in space design.

The features of the present invention will become apparent in the detailed description and examples which follow.

DESCRIPTION OF PREFERRED EMBODIMENTS

Figure 1:
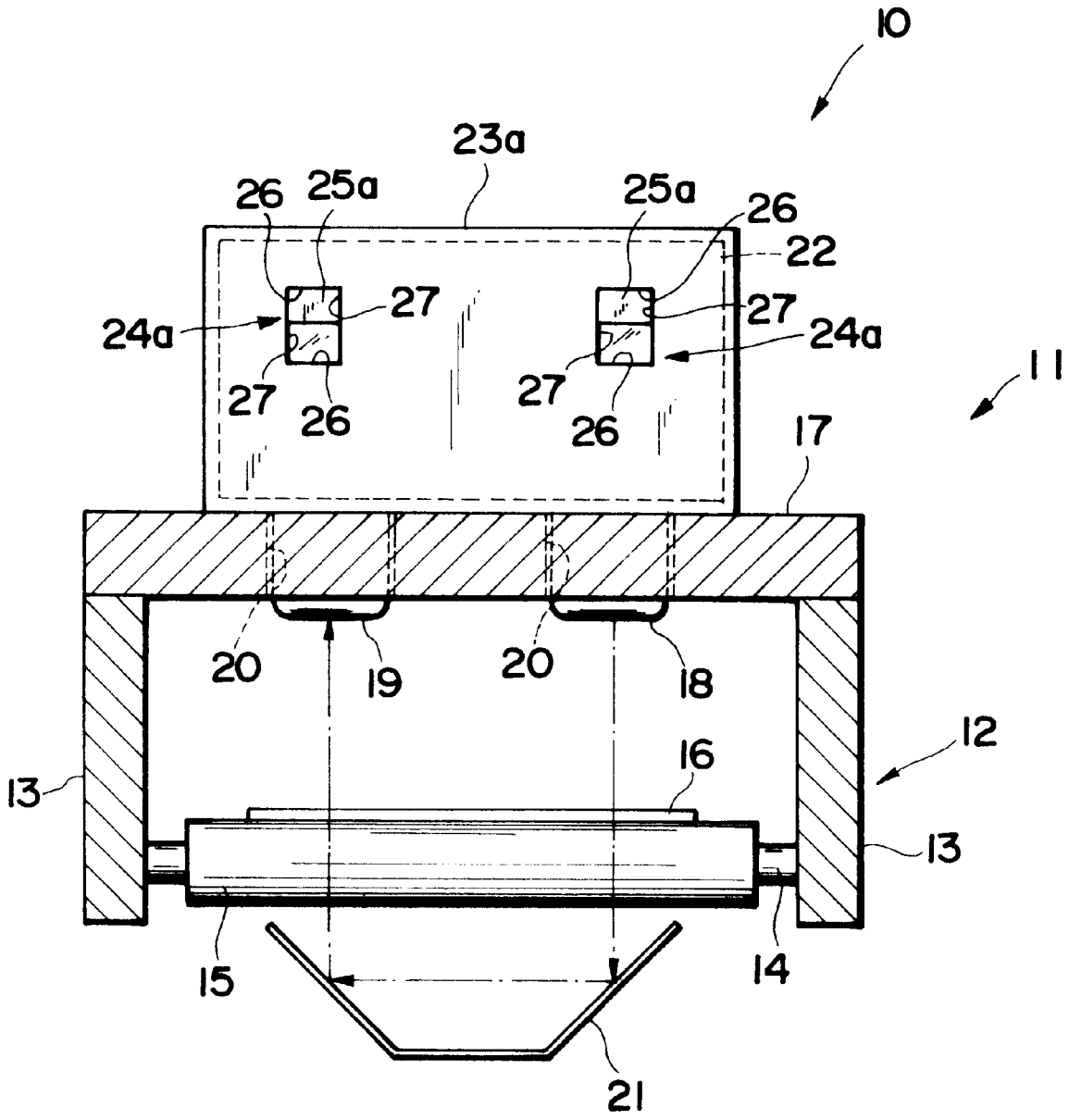
FIG. 1 is a sectional view showing a part of a cash handling machine to which the present invention is applied.

A sensor 10 according to the present invention is provided in conjunction with a transport path 12 of a cash handling machine 11 as shown in FIG. 1, for example.

In the example in FIG. 1, the transport path 12 of the cash handling machine 11 is defined by a pair of frame members 13 extending in parallel and spaced apart from each other along a predetermined route, and a roller conveyer including a plurality of driving rollers 15 arranged between the pair of frame members 13 and spaced apart from one another. Each driving roller 15 has a driving rotary shaft 14 rotatably supported by the frame members 13.

The transport path 12 transports objects 16 being detected, such as bills, for example, along a line of driving rollers 15 of the transport path 12 by the rotation of the driving rollers 15.

A base frame member 17 for supporting the sensor 10 for detecting the object 16 is arranged at an upper position, that is, on one side of the transport path 12 in such a manner as to be spaced apart from the driving rollers 15. The base frame member 17 is supported at its side end portions by the pair of frame members 13.

In the base frame member 17, a pair of through-holes 20 enabling the insertion of a light emitter 18 and a light detector 19 of a sensor 10, which will be described later, are formed across a distance in the width direction of the transport path 12, which coincides with the longitudinal direction of the driving rollers 15.

A well-known reflecting means 21, such as a prism, for reflecting light from the light emitter 18 to the light detector 19 of the sensor 10 is arranged at an upper position, that is, on the other side of the transport path 12.

The sensor 10 includes the light emitter 18, formed by a light emitting element such as a light emitting diode, for example, and the light detector 19, formed by a photoelectric conversion element such as a photodiode, for example, and a sensor body 22 generally of a rectangular shape and made of a synthetic resin material, for example, to hold the light emitter 18 and the light detector 19. A light emitting end face of the light emitter 18 and a light detecting face of the light detector 19 protrude from the bottom face of the sensor body 22. The sensor body 22 is arranged at a predetermined position on the base frame member 17 such that the protruding portions of the light emitter 18 and the light detector 19 can be accepted in the respective through-holes 20.

When the light emitter 18 and the light detector 19 are located at the predetermined positions, light emitted from the light emitter 18 passes through the space about the driving roller 15, reaches the reflecting means 21, then travels by the side of the driving roller 15 and is reflected to the light detector 19. Therefore, the sensor 10 detects the presence or absence of an object 16 as the presence or absence of light detected by the light detector 19.

As a means for positioning the sensor 10 at the predetermined position, a pair of rising portions 23 (23*a* and 23*b*) rising upwardly in parallel with each other along both sides of the sensor body 22 are provided on the base frame member 17 so as to be spaced apart from each other in the transport direction of the transport path 12 (only one rising portion 23*a* is shown in FIG. 1).

In the example in FIG. 1, a pair of two openings 24 (24*a* and 24*a* or 24*b* and 24*b*) are formed at parallel positions in each of the rising portions 23*a* and 23*b* as illustrated. One opening 24*a* or 24*b* of one rising portion 23*a* or 23*b* is paired with the other opening 24*b* or 24*a* of the other rising portion 23*b* or 23*a* to form two pairs of openings.

On both sides of the sensor body 22, there are formed two hook portions 25 (25*a* and 25*a*, or 25*b* and 25*b*) which correspond to the two openings 24 (24*a* and 24*a*, or 24*b* and 24*b*) of each rising portion 23. (Only one set of hooks 25*a* and 25*a* is shown in FIG. 1.)

Figure 2:
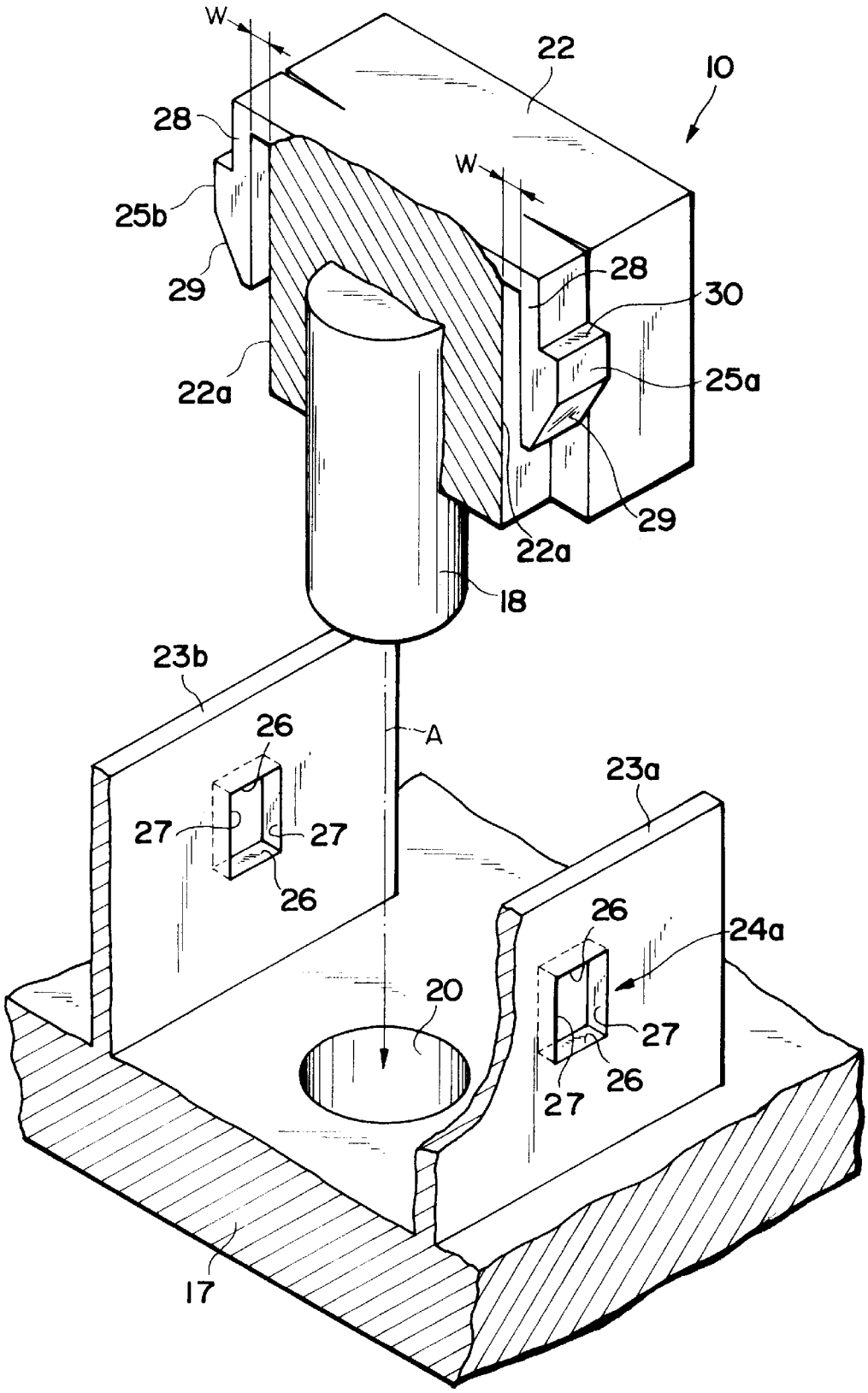
FIG. 2 is an exploded perspective view of mounting structure in FIG. 1, with some portions broken away for clarity.

As shown in FIG. 2, each opening 24 in each rising portion 23 is a rectangular opening defined by inner circumferential portions 26 and 27, each including a pair of horizontal straight edge portions 26 and 26 spaced apart from each other in the rising direction of the rising portion 23 and a pair of vertical straight edge portions 27 spaced apart from each other in the width direction of the transport path 12.

On each side of the sensor body 22, there is an extension block 28 extending integrally with the sensor body 22 from the top portion of the sensor body 22 laterally for a distance W from a side wall 22*a* and then extending at a right angle downwardly toward the bottom of the sensor body 22, terminating in a free end. The distance W is provided to allow the free end portion to undergo a deflection by allowing the extension block 28 to undergo elastic deformation when the extension block 28 is acted on by a pressing force to bring it toward the side wall portion 22*a* in the direction in which the two opposite extension blocks 28 come closer. The side wall portion 22*a* serves to prevent excessive elastic deformation of the extension block 28 by stopping the free end portion of the extension block 28 from being bent further.

A projection constituting one hook portion 25 is formed as an integral part of the extension block 28 on that portion of the outside face which is near the free end portion of each extension block 28 and faces the rising portion 23.

The projection 25 constituting a hook portion 25 has a tapered face 29 which comes closer to the side wall portion 22*a* as one goes from the top to the free end of the extension block 28. Therefore, the shape of each projection 25 is defined by the inclined free end portion 29 and a step portion 30 formed at the base side of the extension block 28 opposite the inclined free end portion 29.

When acted on by the pressing force to urge it toward the side wall portion 22*a*, the projection, that is, the hook portion 25 is capable of elastic deformation by the elastic deformation of the extension block 28 of it.

Consequently, as shown in FIG. 2, if the sensor body 22 is pushed in, with its bottom end face being the first to enter, between both rising portions 23 in the direction of the arrow A from the position from which both hook portions 25 can be led to the corresponding openings 24 in the rising walls 23, then by contact between the tapered face 29 of each hook portion 25 and the corresponding rising portion 23, part of the pushing force can be applied through the tapered face 29 as the pressing force to the hook portion 25.

Figure 3:
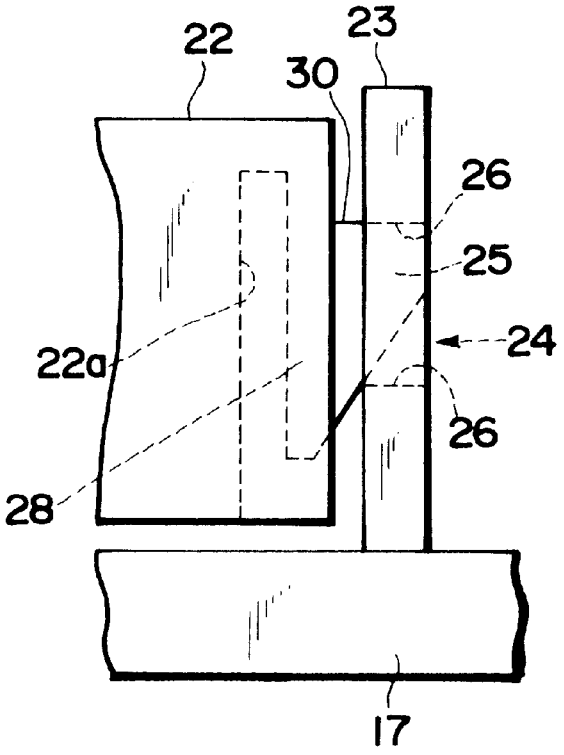
FIG. 3 is a partial side view of the mounting structure in FIG. 2 in which the sensor is mounted.

Therefore, by pushing the sensor body 22 between the rising portions 23, the hook portions 25 can be elastically displaced as they are pressed by the side wall portions 22*a*. Then, as shown in FIG. 3, the sensor body 22 can be pushed to a predetermined position with the hook portions 25 inserted into openings 24.

When the sensor body 22 is located at the predetermined positions, the hook portions 25 are maintained at the recovery position to which the hook portions 25 return by extending from inside the pair of the rising portions 23 outwardly into the openings 24 of the rising portions 23 by the elastic recovery of the extension blocks 28. Each hook portion 25, when it is in the extended position with its projection placed in the opening 24, has its step portion 30 engaged by the upper horizontal straight edge portion 26 of the opening 24, and has its tapered face 29 engaged by the lower horizontal straight edge portion 26, so that the sensor body 22 has its vertical movement regulated, and therefore the sensor 22 is assuredly prevented from being wobbly in the vertical direction. Moreover, the sensor body 22 is prevented from moving horizontally by the hook portions 25 engaging the pair of vertical straight edge portions 27.

Consequently, the sensor body 22 is positioned securely on the base frame member 17 in its predetermined posture in the predetermined position.

As described above, since the hook portions 25 undergo elastic deformation when the sensor body 22 is mounted, the rising portions 23 having the openings 24, which serve as the lock portions and accept the hook portions 25, undergo no deflection as they used in the prior art. Therefore, there is no need to secure a space for allowing the rising portions 23 to deflect, which is advantageous for down-sizing the device during space design.

By depressing from the outside both hook portions 25 of the sensor 22, which are set in the predetermined positions, so that they are entirely inside the rising portions 23, the hook portions 25 can be disengaged from the corresponding lock portions 24. The sensor body 22 having the hook portions 25 disengaged from the corresponding lock portions 24 can be extracted from between the pair of the rising portions 23.

When the sensor body 22 is inserted into or removed from between the rising portions 23, the extension blocks 28 having the hook portions 25 are prevented by the side wall portions 22*a* of the sensor body 22 from being subjected to excessive elastic deformation. Therefore, the extension blocks 28 are prevented from being damaged by excessive deformation during mounting or removing the sensor body 22, so that the durability of the mounting-associated portions can be improved.

Figure 4:
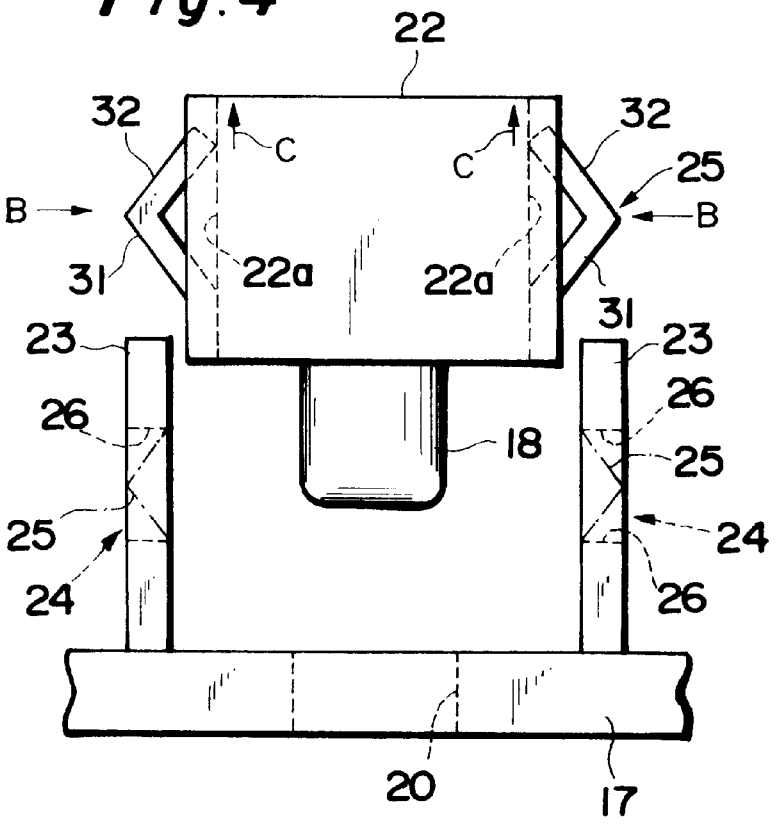
FIG. 4 is a side view as in FIG. 3, but which shows another embodiment of the present invention.

Instead of the extension blocks and the projections mentioned above, the hook portions 25 can be formed by first and second plate-form inclined portions 31 and 32 located on both sides of the sensor body 22 as shown in FIG. 4.

Each first inclined portion 31 is provided so as to extend from a position close to the bottom face as the insertion end of the sensor body 22 toward the top end of the sensor body 22 by gradually increasing the distance W from the side wall portion 22*a* of the sensor body 22. Each second inclined portion 32 extends from the extension end of the first inclined portion 31 at a reversed angle with respect to the angle of the first inclined portion 31 toward the top end of the sensor body 22, thus terminating in a free end. The first inclined portion 31 and the second inclined portion 32 jointly constitute each projection 25 so as to have a generally L-shaped longitudinal cross section, with its top end extending to the side of the sensor body 22.

When the projection shown in FIG. 4, that is, the hook portion 25, has its top end portion, extending from the sensor body 22, acted on by a pressing force in the direction indicated by the symbol B in FIG. 4, the hook portion 25 undergoes elastic deformation including the displacement of the projection in its entirety as well as the displacement of the free end of the second inclined portion 32 in the direction indicated by the symbol C along the side wall portion 22*a* as shown in FIG. 4.

Therefore, as in the example shown in FIGS. 1 to 3, the sensor body 22 can be positioned at the predetermined location by engaging the hook portions 25, each including the first inclined portion 31 and the second inclined portion 32, into the openings 24 of the rising portions 23 as indicated by the imaginary lines in FIG. 4.

In the example in FIG. 4, the vertical movement of the sensor body 22 is regulated by the engagement of the tapered faces defined by the first inclined portion 31 and the second inclined portion 32 with a pair of horizontal straight edge portions 26 of each opening 24.

Therefore, even if a relatively small value is set for the distance between the pair of horizontal straight edge portions 26 of each opening 24, the movement of the sensor body 22 can be assuredly restricted by the elasticity of the projections 25 in themselves, which enables relatively large allowable errors to be set in the production stage.

However, in the projection 25 including the first inclined portion 31 and the second inclined portion 32, the stress resulting from its elastic deformation is liable to concentrate in the base portion of the first inclined portion 31.

On the other hand, as shown in FIGS. 1 to 3, in the embodiment in which the projections 25 are formed near the free ends of the respective extension blocks 28, the stress owing to the elastic deformation of each extension block 28 is generally dispersed in the extending direction of the extension block 28 without concentrating in the base portion of the extension block 28.

Therefore, with respect to durability, the embodiment shown in FIGS. 1 to 3 is more advantageous than other forms of embodiment.

Figure 5:
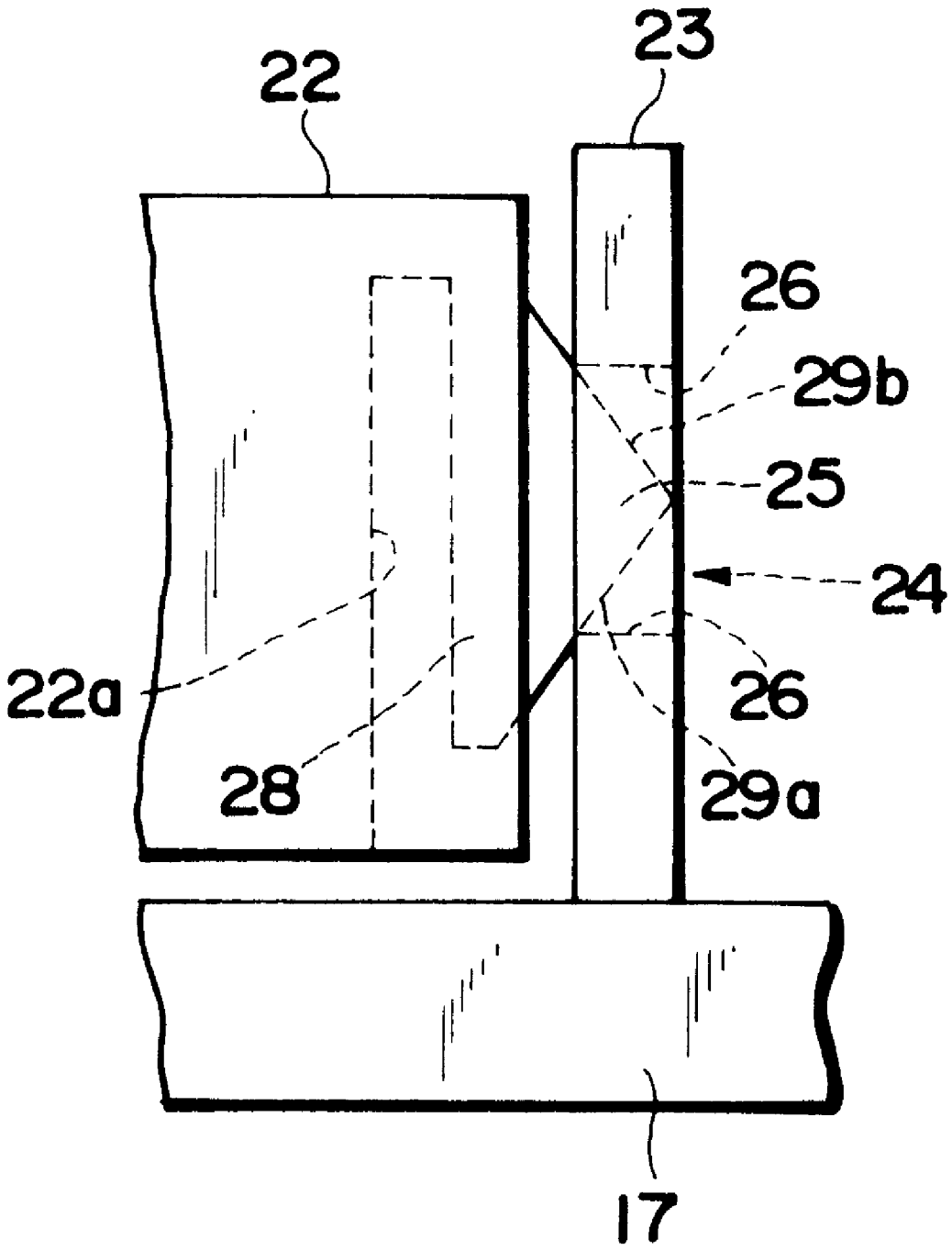
FIG. 5 is a side view as in FIG. 3, but which shows yet another embodiment of the present invention.

As shown in FIG. 5, the projection 25 at each extension block 28 may be formed with a triangular longitudinal cross section, including an apex angle defined by the first and second tapered faces 29*a* and 29*b*.

In the embodiment of FIG. 5, in the extension block 28 with the projection 25, as mentioned above, the stress due to its elastic deformation is adequately dispersed. Moreover, a relatively small value may be set for the distance between the pair of horizontal straight edge portions 26 of each opening 24 so that both tapered faces 29*a* and 29*b* assuredly engage the pair of the horizontal straight edge portions 26 by the elasticity of the extension block 28.

Thus, since the movement of the sensor body 22 can be restricted, relatively large allowable errors may be set in the manufacturing process of this sensor mounting structure.

In the foregoing, the present invention has been described taking as an example of a sensor for use in a cash handling machine, but the present invention is not limited to such applications, and may be applied to various kinds of sensor mounting structures. Also, embodiments in which a transmission type sensor is mounted on a transport path including a roller conveyer have been described, but the present invention may be applied to a structure for mounting a reflection type sensor which detects, at the light detector, the light emitted by the light emitter and reflected from the object being transported.

In this reflection type sensor, the light transmission through the transport path itself does not matter, so that belt conveyer equipment may be used for the transport path.

In the embodiments illustrated, the light emitter and the light detector were mounted in one sensor body, but the light emitter and the light detector may be mounted in separate housings regardless of whether the sensor is of the transmission type or of the reflection type, and the sensor mounting structure according to the present invention may be applied to such separate housings.

Further, any of various types of slots or the like may be adopted for the lock portions for accepting the projections.

What is claimed is:

1. A sensor mounting structure comprising:

a frame member to be positioned along one side of a transport path;

a sensor body including at least one of a light emitter and a light detector for detecting an object being transported along the transport path;

a pair of rising portions that are spaced apart from each other and that extend from said frame member along sides of said sensor body, each of said rising portions having a lock portion; and a pair of hook portions on said sensor body, said pair of hook portions releasably engaging said lock portions, and said pair of hook portions being elastic such that each of said hook portions is capable of being deformed elastically in a direction in which said hook portions come closer to each other for the purpose of engaging and disengaging said lock portions and such that when said hook portions are engaged or disengaged with said lock portions of said pair of rising portions, said hook portions are elastically deformed and said pair of rising portions are prevented from deflecting.

2. A sensor mounting structure according to claim 1, wherein said lock portions have rectangular openings, and said hook portions have projections capable of protruding through said openings from the inside to the outside of said pair of rising portions.

3. A sensor mounting structure according to claim 2, wherein each said opening is defined by an inner circumferential portion including a pair of straight edge portions spaced apart from each other in a rising direction of the rising portions, and each of said projections includes two tapered faces capable of engaging said pair of straight edge portions, and movement of said sensor body in the rising direction of said rising portions is regulated by engagement of said tapered faces with corresponding ones of said pair of straight edge portions.

4. A sensor mounting structure according to claim 2, wherein one of said hook portions comprises a first plate-form inclined portion extending from a position close to an end of said sensor body for insertion between said pair of rising portions and extending toward an end opposite to the end of said sensor body for insertion by gradually increasing the distance from a side wall portion of said sensor body, and a second plate-form inclined portion extending from an extension end of said first inclined portion at an angle reversed with respect to the angle of said first plate-form inclined portion toward the end opposite to the end for insertion and terminating in a free end, wherein said first and second plate-form inclined portions jointly constitute one of said projections.

5. A sensor mounting structure according to claim 1, wherein said sensor body is made of an elastically deformable synthetic resin material.

6. A sensor mounting structure according to claim 1, wherein on a face of said sensor body facing the transport path, there are arranged close to each other a light emitter and a light detector to receive part of the light emitted by said light emitter and reflected by an object being transported on the transport path.

7. A sensor mounting structure for supporting by a frame member on one side of a transport path a sensor body, including at least one of a light emitter and a light detector, for detecting an object being transported along the transport path, said mounting structure comprising:

a pair of rising portions spaced apart from each other and rising from said frame member along both sides of said sensor body, each rising portion having a lock portion; and a pair of hook portions releasably engaging said lock portions, wherein each of said hook portions is capable of being deformed elastically in the direction in which both hook portions come closer to each other in order to engage or disengage the corresponding one of said lock portions;

wherein said lock portions have rectangular openings, and said hook portions have projecting portions capable of protruding through said openings from the inside of said pair of rising portions toward the outside of said pair of rising portions; and wherein each of said hook portions comprises an elastically deformable extension block extending integrally from a portion of a side wall of said sensor body over a predetermined distance from and laterally to the side wall of said sensor body, the portion of the side wall being opposite to an insertion end portion of said sensor body, said elastically deformable extension block terminating in a free end, and said free end having a respective one of said projecting portions on the outside thereof.

8. A sensor mounting structure according to claim 7, wherein each of said projecting portions in a direction away from said sensor body and has a tapered face that becomes thinner toward said free end.

9. A sensor mounting structure according to claim 8, wherein each of said projecting portions has a triangular longitudinal cross section to let its apex angle portion protrude into said opening, and said sensor body is positioned on said frame member with the two faces forming said apex angle engaged by said edge portions of each said opening.

10. A sensor mounting structure comprising:

a frame member positioned along one side of a transport path;

a sensor body including at least one of a light emitter and a light detector for detecting an object being transported along the transport path;

a pair of mounting portions that are spaced apart from each other and that extend from said frame member along sides of said sensor body, each of said mounting portions having a lock portion; and a pair of hook portions on said sensor body, said pair of hook portions releasably engaging said lock portions, and said pair of hook portions being elastic such that each of said hook portions is capable of being deformed elastically in a direction in which said hook portions come closer to each other for the purpose of engaging and disengaging said lock portions, wherein said pair of mounting portions are relatively rigid with respect said pair of hook portions such that when said hook portions are engaged or disengaged with said lock portions of said pair of mounting portions, said hook portions are elastically deformed and said pair of mounting portions are prevented from deflecting.

11. The sensor mounting structure of claim 10, wherein said lock portions comprise holes in said mounting portions and said hook portions comprise cantilevered members having projections at free ends thereof for engagement with said holes of said lock portions.

12. The sensor mounting structure of claim 11, wherein said projections comprise tapered faces facing said mounting portions.

* * * * *